US008056883B1

(12) United States Patent
Brockie

(10) Patent No.: US 8,056,883 B1
(45) Date of Patent: Nov. 15, 2011

(54) MANUAL STORAGE LIFT SYSTEM

(76) Inventor: Scott Brockie, Tavares, FL (US)

( * ) Notice: Subject to any disclaimer, the term of this patent is extended or adjusted under 35 U.S.C. 154(b) by 341 days.

(21) Appl. No.: 12/435,065

(22) Filed: May 4, 2009

(51) Int. Cl.
*B66D 1/26* (2006.01)

(52) U.S. Cl. ..... 254/278; 254/286; 254/338; 254/370

(58) Field of Classification Search ..... 254/278, 254/286, 338, 370, 375, 378
See application file for complete search history.

(56) References Cited

U.S. PATENT DOCUMENTS

| | | | | | |
|---|---|---|---|---|---|
| 410,507 | A | | 9/1889 | Fain | |
| 983,957 | A | * | 2/1911 | Trantham | 254/338 |
| 2,686,659 | A | | 8/1954 | Bittner | |
| 3,809,422 | A | | 5/1974 | Schlough | |
| 4,065,100 | A | * | 12/1977 | Walsh | 254/368 |
| D257,028 | S | | 9/1980 | Row | |
| 4,408,728 | A | * | 10/1983 | Pittman | 242/300 |
| 4,600,177 | A | * | 7/1986 | Fritz | 254/338 |
| 4,892,203 | A | | 1/1990 | Arav | |
| 4,927,537 | A | | 5/1990 | Meurer | |
| 5,263,687 | A | | 11/1993 | Garbiso | |
| 5,280,715 | A | | 1/1994 | Baldwin | |
| 5,897,104 | A | | 4/1999 | Garbiso | |
| 6,056,274 | A | * | 5/2000 | Naas et al. | 254/335 |
| 6,105,938 | A | | 8/2000 | Koida | |
| 6,152,427 | A | * | 11/2000 | Hoslett | 254/338 |
| 6,386,515 | B1 | | 5/2002 | Sachtleben | |
| 6,507,962 | B2 | * | 1/2003 | Thurston | 5/10.1 |
| 6,957,804 | B2 | | 10/2005 | Heggestad | |
| 6,959,918 | B1 | * | 11/2005 | Samuels | 254/338 |
| 6,969,049 | B2 | | 11/2005 | Bilcik | |
| 6,991,064 | B2 | | 1/2006 | Ehrenleitner | |
| 7,025,334 | B2 | | 4/2006 | Ehrenleitner | |
| 7,150,449 | B1 | | 12/2006 | Dueck et al. | |
| 2002/0178497 | A1 | * | 12/2002 | Thurston | 5/10.1 |

OTHER PUBLICATIONS

Costco, "Racor ProStor Heavylift", <retrieved from http://www.costco.com/Browse/Product.aspx? ...> Apr. 22, 2009, 2 pages.

* cited by examiner

*Primary Examiner* — Emmanuel M Marcelo
(74) *Attorney, Agent, or Firm* — Neustel Law Offices

(57) ABSTRACT

A manual storage lift system for efficiently hoisting articles to a raised position for providing temporary or permanent storage for the articles. The manual storage lift system generally includes a drive unit including a mounting plate mounted on a vertical surface, a shaft rotatably connected to the mounting plate, a spool coaxially positioned along the shaft, wherein the spool rotates independently of the shaft, at least one elongated member wound upon the spool, a hand crank connected to the shaft for winding or unwinding the at least one elongated member upon the spool and a brake assembly mounted to the drive unit, wherein the brake assembly includes a torsion spring. A first force applied with the hand crank in a rotational direction upon the torsion spring lessens a tension of the torsion spring allowing the torsion spring and the spool to rotate. A second force applied with the spool in the rotational direction upon the torsion spring increases a tension of the torsion spring preventing the torsion spring and the spool from rotating. The elongated members connect to a platform through a series of pulleys mounted on an overhead horizontal surface to raise and lower the platform through operation of the hand crank.

17 Claims, 11 Drawing Sheets

MANUAL STORAGE LIFT SYSTEM

CROSS REFERENCE TO RELATED APPLICATIONS

Not applicable member to this application.

STATEMENT REGARDING FEDERALLY SPONSORED RESEARCH OR DEVELOPMENT

Not applicable member to this application.

BACKGROUND OF THE INVENTION

1. Field of the Invention

The present invention relates generally to a storage system and more specifically it relates to a manual storage lift system for efficiently hoisting articles to a raised position for providing temporary or permanent storage for the articles.

2. Description of the Related Art

Any discussion of the related art throughout the specification should in no way be considered as an admission that such related art is widely known or forms part of common general knowledge in the field.

Storage systems have been in use for years and are built in various styles and configurations. Storage systems may be simply comprised of shelves stacked in a vertical manner. A common frustration with shelves either stacked, or suspended, is that it is often difficult to access articles upon some of the higher shelves. Further accessing the articles haphazardly can cause a dangerous situation for the user, wherein the user poses a greater risk to falling (if standing on a ladder, chair, or other support) and/or dropping the articles.

Other methods of storing articles, such as putting them directly on the floor, can lead to the articles getting in the way of the user, taking up an abundance of space that may be used for other purposes, or becoming damaged due to being ran into, engaged, or walked upon by the user or other persons. Because of the inherent problems with the related art, there is a need for a new and improved manual storage lift system for efficiently hoisting articles to a raised position for providing temporary or permanent storage for the articles.

BRIEF SUMMARY OF THE INVENTION

A system for efficiently hoisting articles to a raised position for providing temporary or permanent storage for the articles. The invention generally relates to a storage system which includes a mounting plate mounted on a vertical surface, a shaft rotatably connected to the mounting plate, a spool coaxially positioned along the shaft, wherein the spool rotates independently of the shaft, at least one elongated member wound upon the spool, a hand crank connected to the shaft for winding or unwinding the at least one elongated member upon the spool and a brake assembly mounted to the drive unit, wherein the brake assembly includes a torsion spring. A first force applied with the hand crank in a rotational direction upon the torsion spring lessens a tension of the torsion spring allowing the torsion spring and the spool to rotate. A second force applied with the spool in the rotational direction upon the torsion spring increases a tension of the torsion spring preventing the torsion spring and the spool from rotating. The elongated members connect to a platform through a series of pulleys mounted on an overhead horizontal surface to raise and lower the platform through operation of the hand crank.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
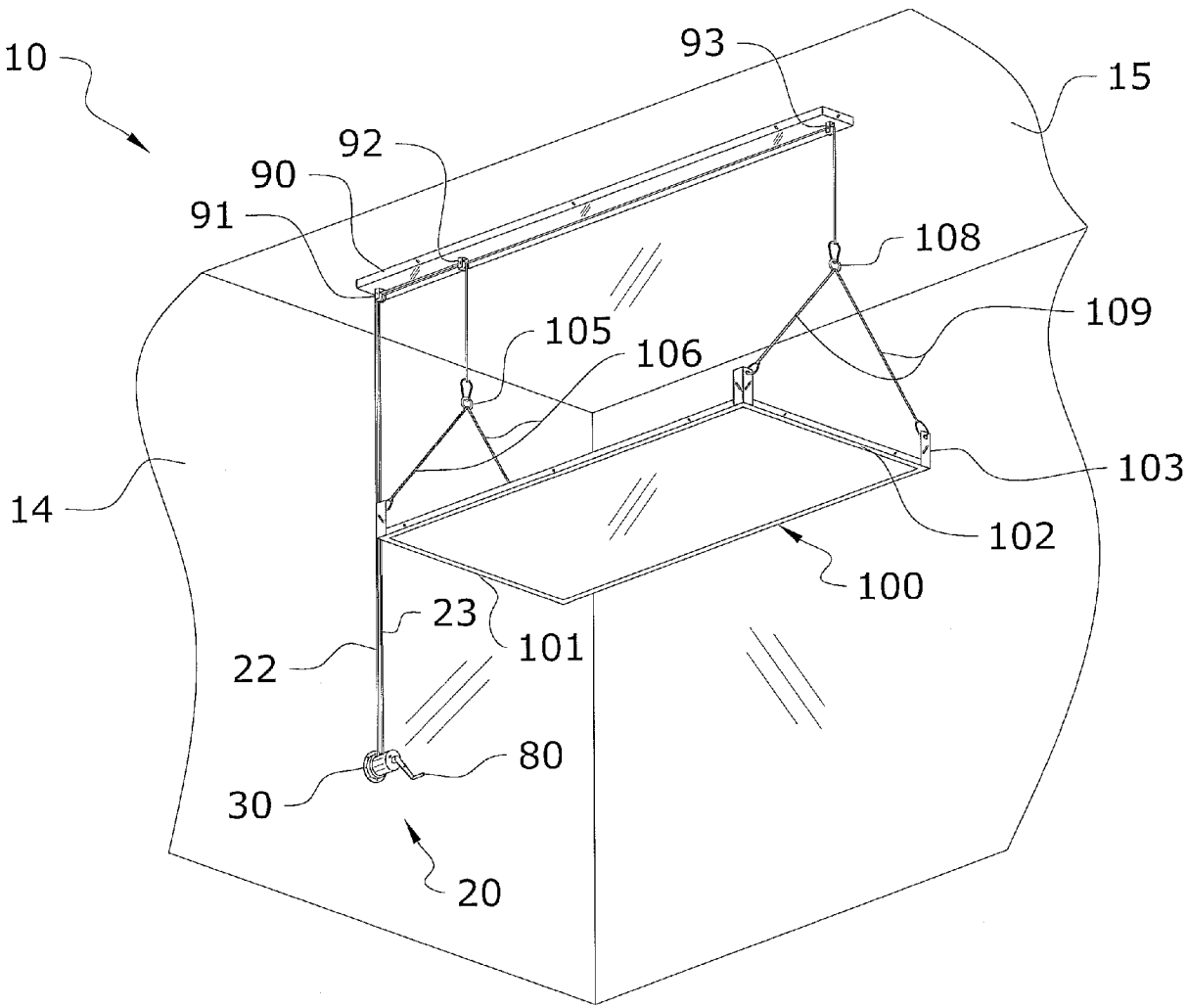
FIG. 1 is a lower perspective view of the present invention.
Figure 2:
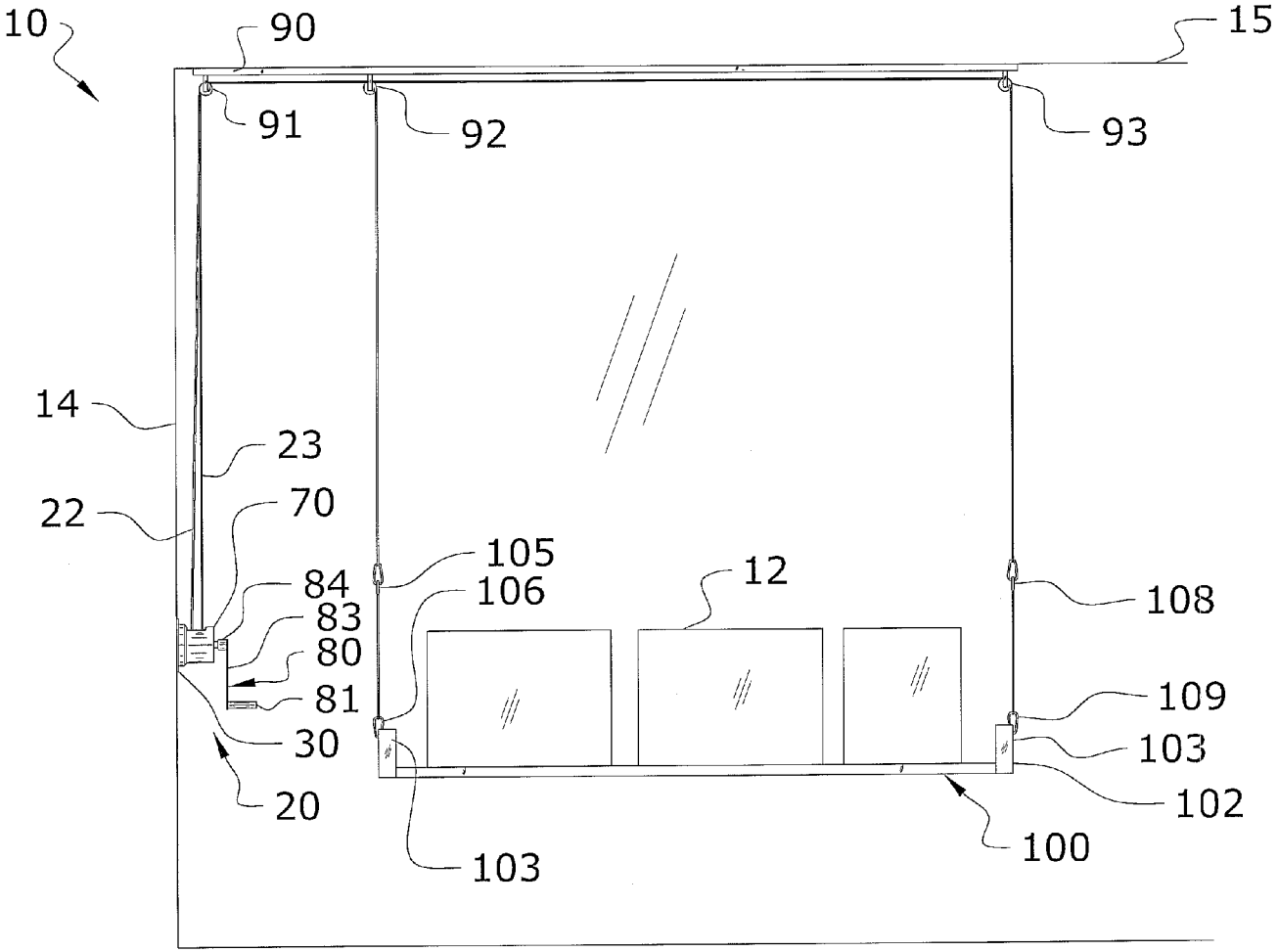
FIG. 2 is a side view of the present invention in a lowered position.
Figure 3:
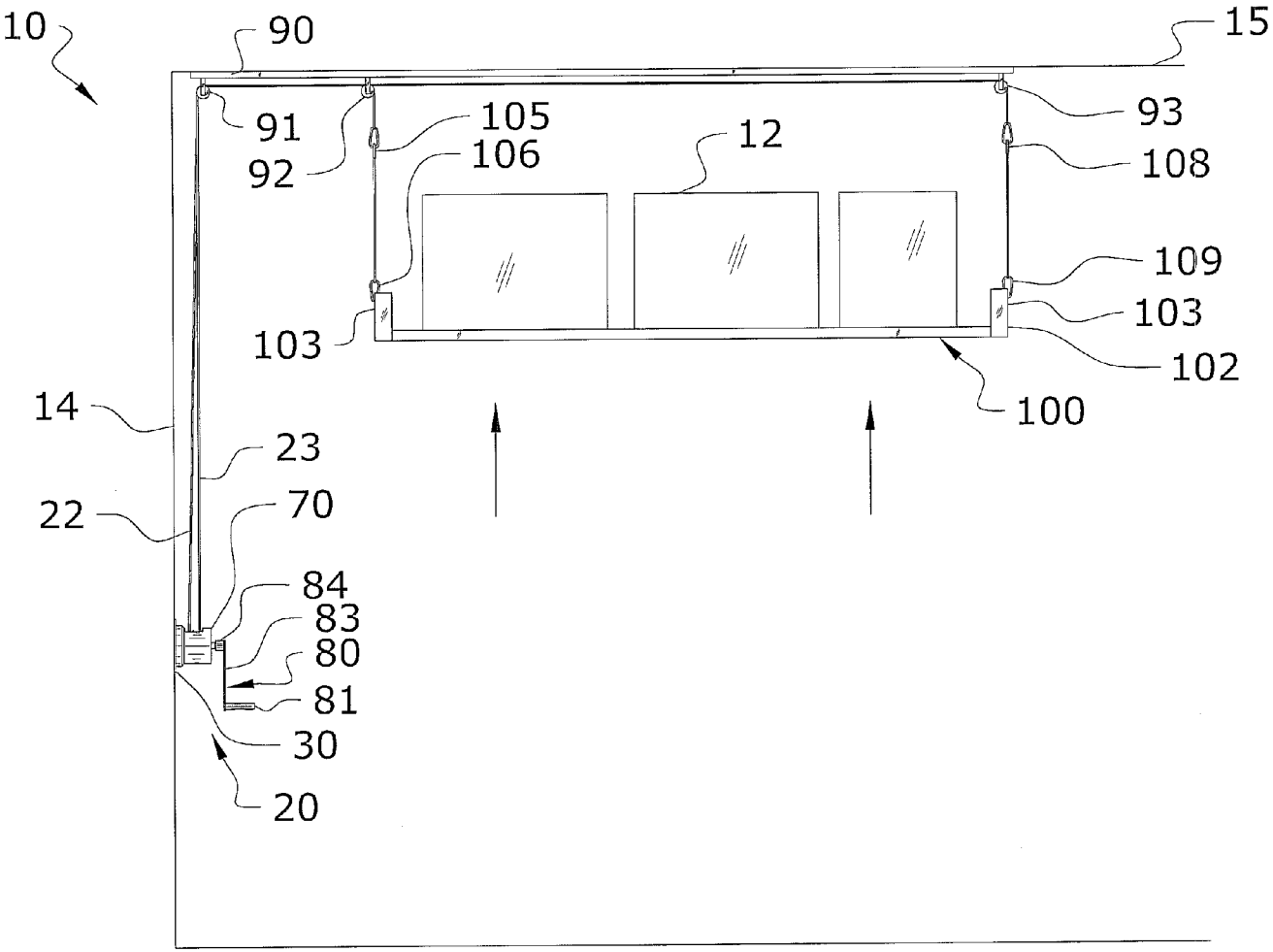
FIG. 3 is a side view of the present invention in a raised position.
Figure 4:
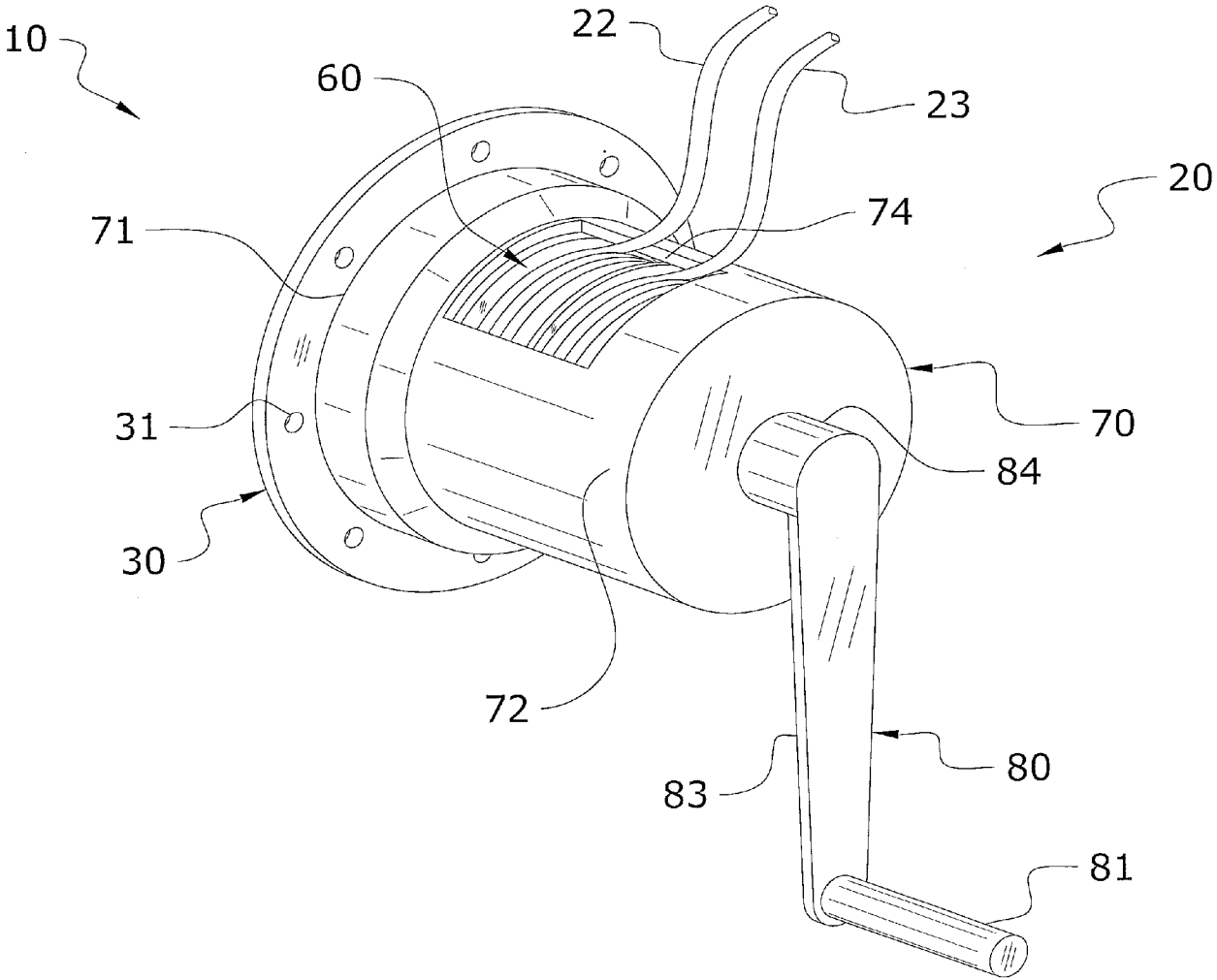
FIG. 4 is an upper perspective view of the drive unit.
Figure 5:
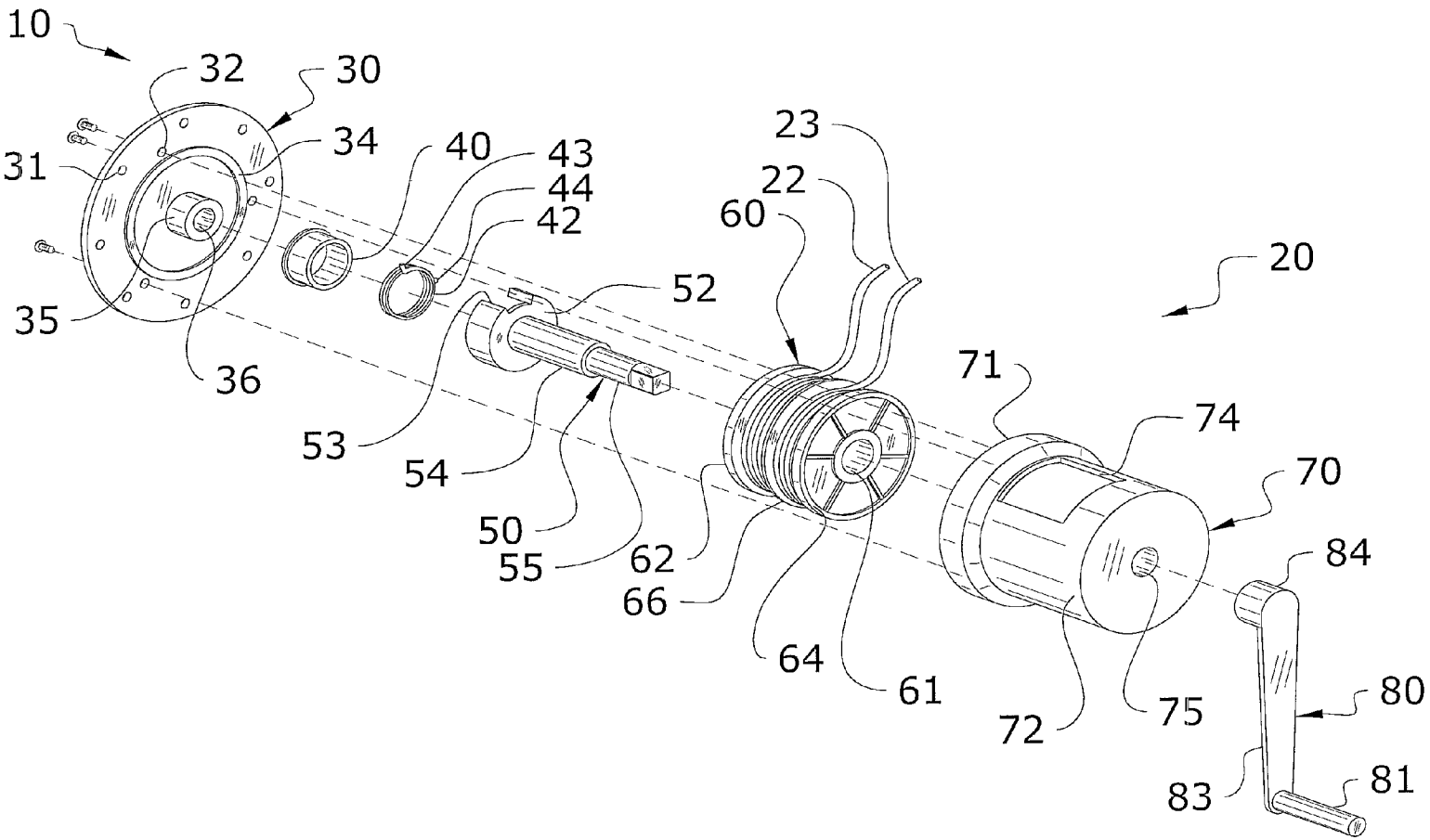
FIG. 5 is an exploded upper perspective view of the drive unit.
Figure 6:
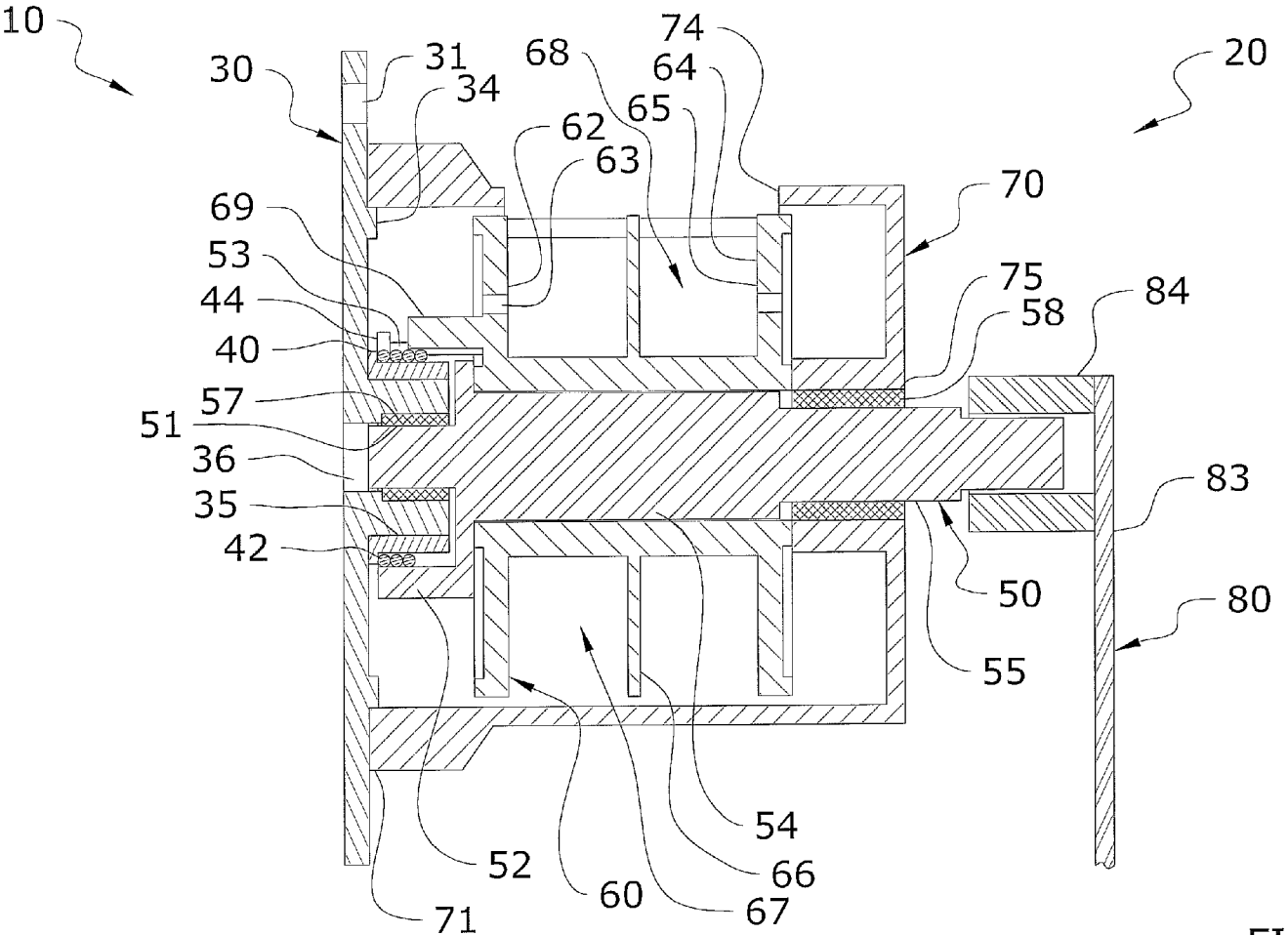
FIG. 6 is a sectional view of the drive unit taken along a longitudinal axis.
Figure 7:
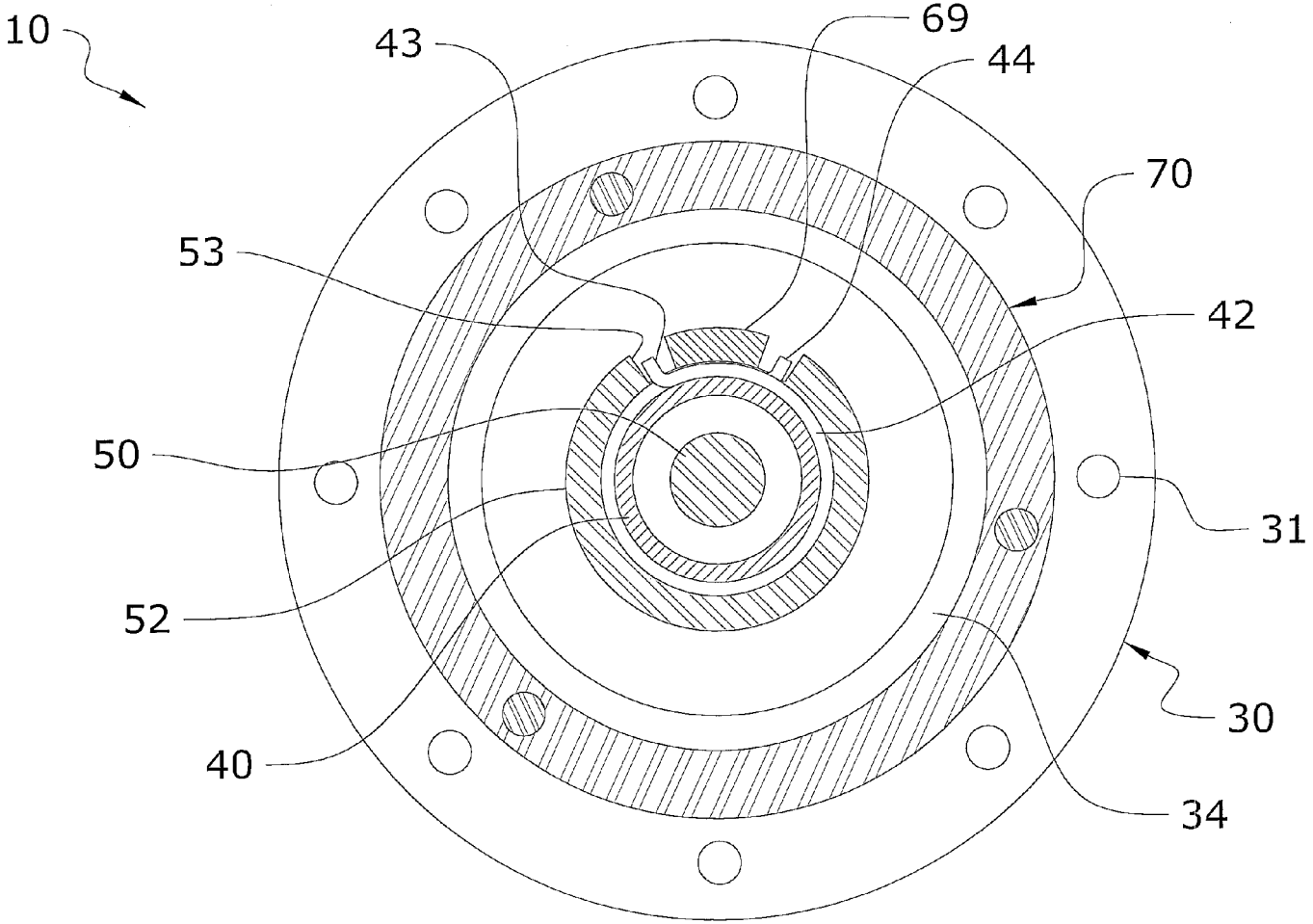
FIG. 7 is a sectional view of the drive unit taken along across the brake assembly with the spool in a neutral position.
Figure 8:
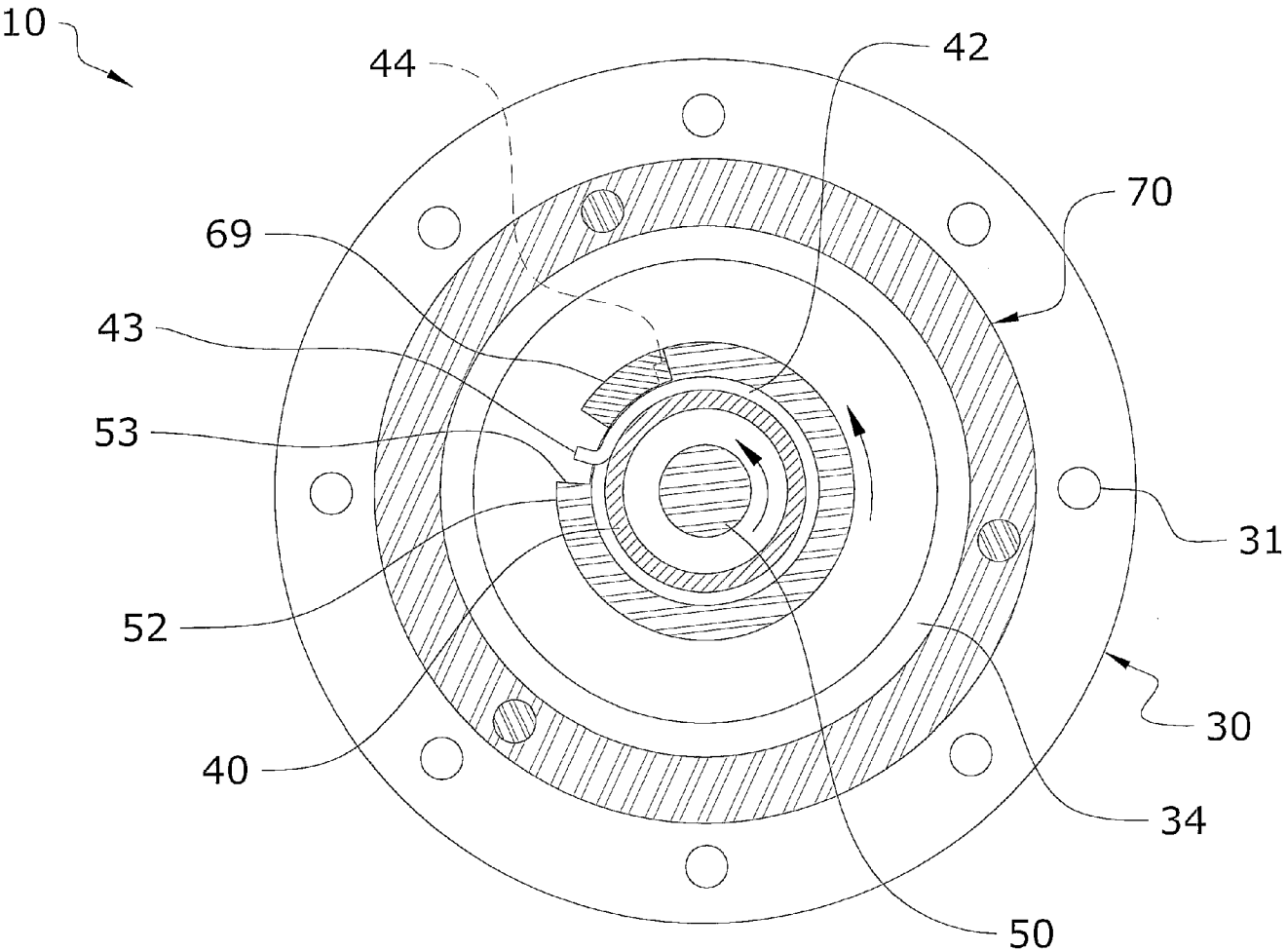
FIG. 8 is a sectional view of the drive unit taken along across the brake assembly with the spool being rotated by the hand crank to raise the load.
Figure 9:
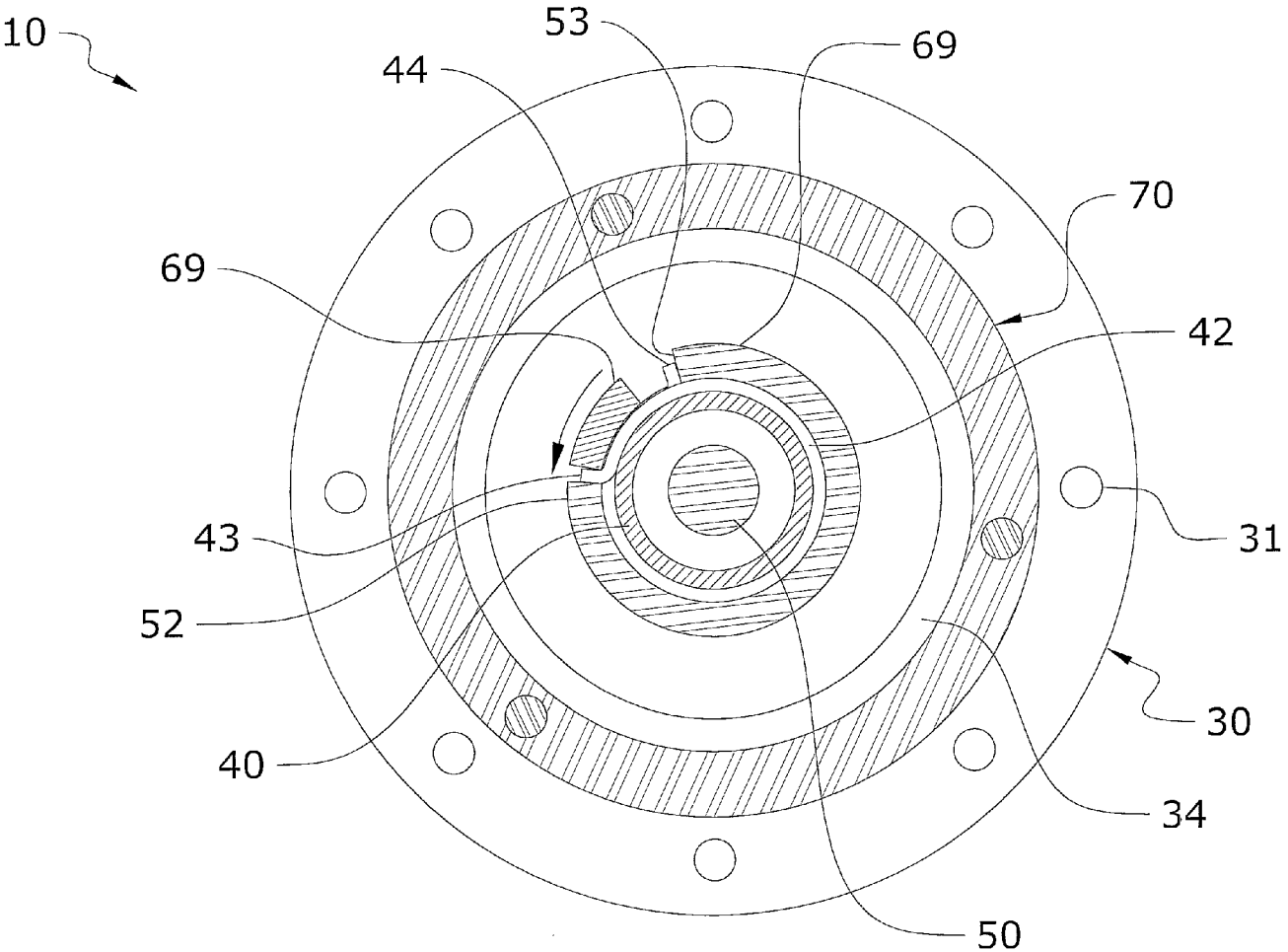
FIG. 9 is a sectional view of the drive unit taken along across the brake assembly with the spool rotating independently of the hand crank to engage the brake assembly by tightening the brake spring about the brake bushing.
Figure 10:
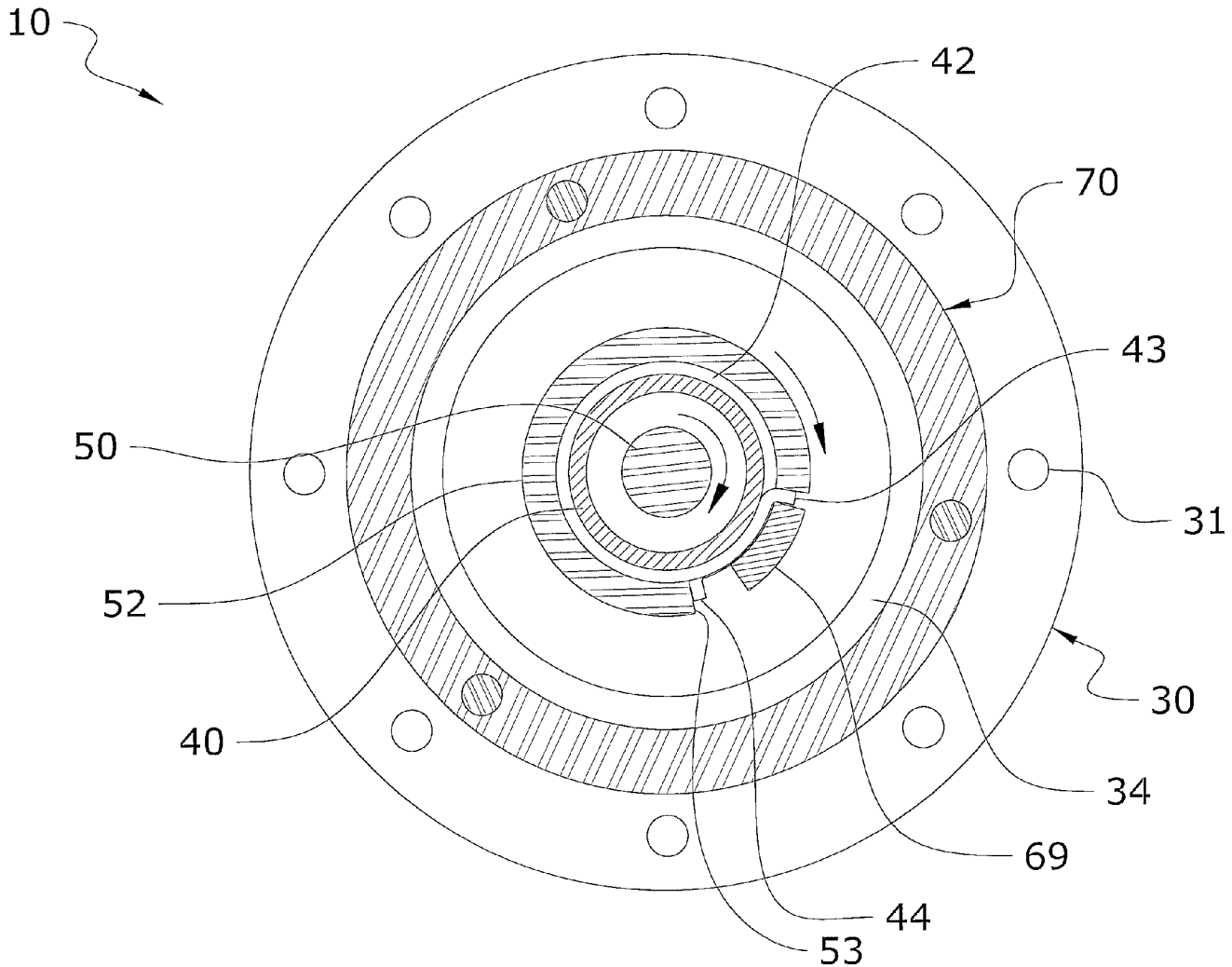
FIG. 10 is a sectional view of the drive unit taken along across the brake assembly with the spool being rotated by the hand crank to lower the load.
Figure 11:
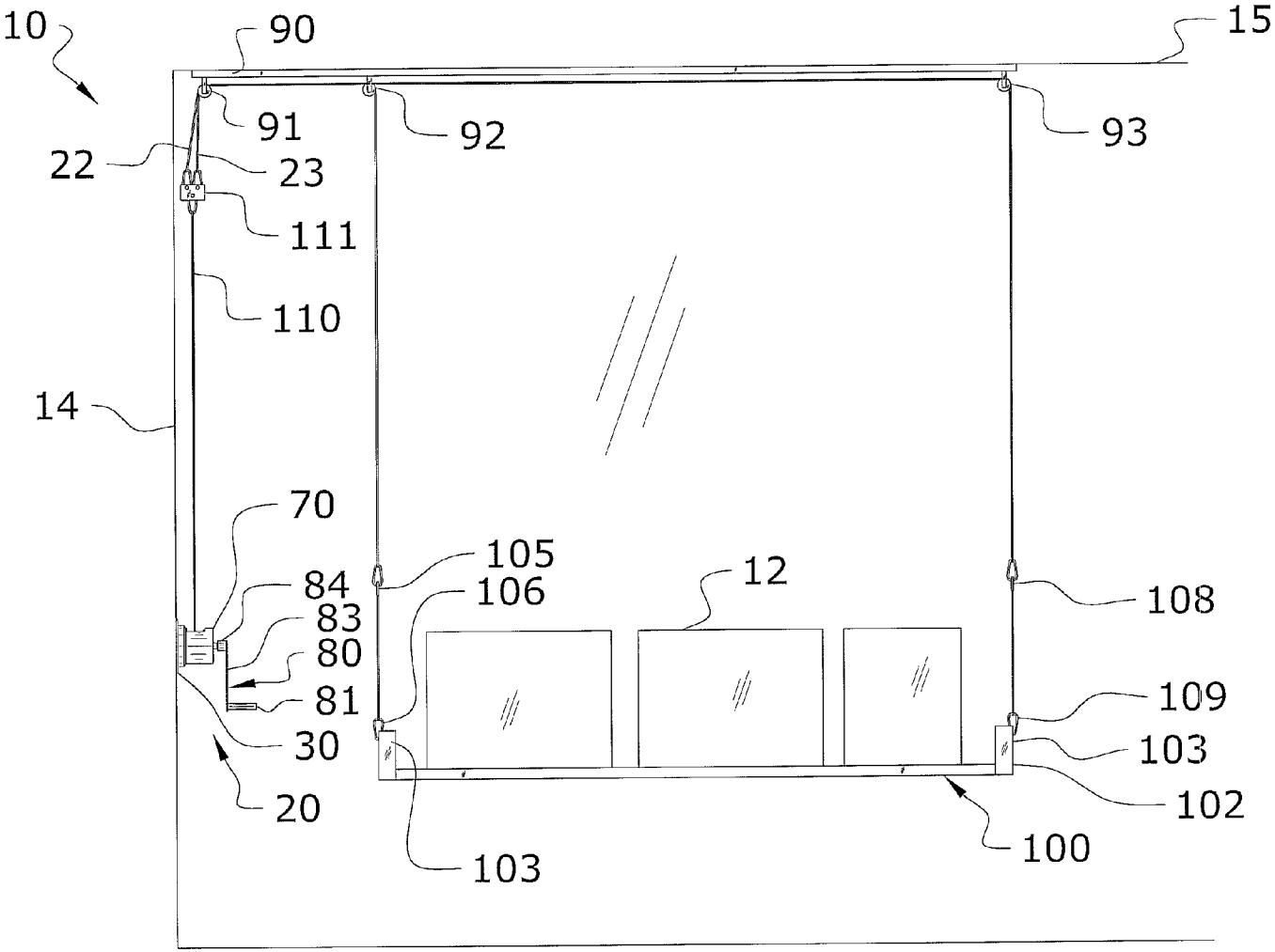
FIG. 11 is a side view of the present invention in a lowered position with an alternate embodiment of the elongated members where only an initial elongated member is wound around the spool.

Turning now descriptively to the drawings, in which similar reference characters denote similar elements throughout the several views, FIGS. 1 through 11 illustrate a manual storage lift system 10, which comprises a mounting plate 30 mounted on a vertical surface 14, a shaft 50 rotatably connected to the mounting plate 30, a spool 60 coaxially positioned along the shaft 50, wherein the spool 60 rotates independently of the shaft 50, at least one elongated member 22, 23 wound upon the spool 60, a hand crank 80 connected to the shaft 50 for winding or unwinding the at least one elongated member 22, 23 upon the spool 60 and a brake assembly mounted to the drive unit 20, wherein the brake assembly includes a torsion spring 42. A first force applied with the hand crank 80 in a rotational direction upon the torsion spring 42 lessens a tension of the torsion spring 42 allowing the torsion spring 42 and the spool 60 to rotate. A second force applied with the spool 60 in the rotational direction upon the torsion spring 42 increases a tension of the torsion spring 42 preventing the torsion spring 42 and the spool 60 from rotating. The elongated members 22, 23 connect to a platform 100 through a series of pulleys mounted on an overhead horizontal surface 15 to raise and lower the platform 100 through operation of the hand crank 80.

B. Drive Unit

The present invention includes a drive unit 20 preferably comprised of a manual crank winch structure. The drive unit 20 is preferably mounted on a vertical wall 14 and used to raise and lower a platform 100 in a vertical manner. The drive unit 20 preferably winds and unwinds a first elongated member 22 and a second elongated member 23 to correspondly support a first end 101 and a second end 102 of a platform 100 or other load 12 supporting assembly. The first elongated member 22 and the second elongated member 23 may be comprised of cables, ropes, or any elongated structure capable of being wound around the spool 60 and supporting the weight of the platform 100 and load 12.

It is appreciated that since the first elongated member 22 travels a shorter distance than the second elongated member 23, the first elongated member 22 may be shorter in length than the second elongated member 23. The drive unit 20 may be used in various locations, such as a garage, shed, room, or in an open space, so long as the drive member includes at least one vertical surface 14 for affixing the drive unit 20 to and a horizontal surface 15 overhead of the vertical surface 14 for affixing the horizontal support 90 thereto.

i. Mounting Plate

The drive unit 20 includes a mounting plate 30 to secure the drive unit 20 to the vertical wall in a fixed manner. The mounting plate 30 includes an outer rim preferably flat on a wall adjacent side and flat upon an opposing side. A plurality of mounting holes 31 extend through the mounting plate 30 for receiving fasteners to secure the mounting plate 30 to the vertical surface 14. The mounting holes 31 generally follow a perimeter of the outer rim. A plurality of attachment holes 32 also preferably extend through the mounting plate 30 radially inside of the mounting holes 31 for receiving the inner rim 71 of the cover 70 and thus affixing the cover 70 to the mounting plate 30.

A lip 34 surrounds an inner diameter of the mounting plate 30 radially inside of the attachment holes 32 for supporting the inner rim 71 of the cover 70. Extending outwardly form the mounting plate 30 radially inside of the lip 34 is a non rotatable inner hub 35 which includes a center opening 36 extending therethrough for receiving the shaft 50.

ii. Brake Assembly

The brake assembly is used to prevent the spool 60 from unwinding when no rotational force is being applied to the hand crank 80. The brake assembly includes a brake bushing 40 that is secured to the outer diameter of the inner hub 35 in a fixed and non rotatable manner. The brake bushing 40 is preferably comprised of a cylindrical shaped configuration to match the configuration of the inner hub 35.

The brake assembly also includes a brake spring 42 preferably comprised of a torsion spring that is positioned around the brake bushing 40. It is appreciated that in various alternate configurations, the brake spring 42 may be positioned directly around the inner hub 35. The brake spring 42 serves to prevent the spool 60 from rotating when the hand crank 80 and shaft 50 are not rotating. The brake spring 42 automatically engages when no rotational force is being applied to the hand crank 80 by tightening around the brake bushing 40 so as to prevent rotation of the brake spring 42 with respect to the brake bushing 40 and hold the spool 60 in place via an upwardly angled first prong 43 extending from one end of the brake spring 42.

The brake spring 42 includes the first prong 43 extending from one end and an upwardly angled second prong 44 extending from an opposing end of the brake spring 42. The first prong 43 is positioned upon an outside end of the brake spring 42 and the second prong 44 is positioned upon an inside end of the brake spring 42 adjacent the mounting plate 30.

iii. Shaft

A shaft 50 is secured within the inner hub 35 of the mounting plate 30 to be rotated via the handle 81 when the spool 60 is desired to be rotated and thus platform 100 raised or lowered. The shaft 50 is preferably comprised of a solid and rigid structure. The shaft 50 includes an inner portion 51 of a generally smaller and uniform diameter than the rest of the shaft 50 that is positioned within center opening 36 of the inner hub 35. An inner bearing 57 is also preferably positioned between the inner portion 51 and the inner hub 35 within the center opening 36 for allowing the shaft 50 to rotate smoothly within the center opening 36 of the inner hub 35.

Extending radially outwardly between the inner portion 51 and a central portion 54 of the shaft 50 is an outer hub 52. The outer hub 52 extends radially outwardly from the shaft 50 and over a majority of the inner hub 35, brake bushing 40 and brake spring 42. The outer hub 52 is preferably positioned directly over the brake spring 42 and in contact with the brake spring 42 to provide a frictional force to create resistance while winding or unwinding the elongated members 22, 23.

The outer hub 52 also includes a notch 53, preferably of a square shape, that extends within the notch 53 parallel with the brake spring 42, wherein the first prong 43 and the second prong 44 of the brake spring 42 are positioned within the notch 53. When the shaft 50 is rotated, the outer hub 52, being integral with the shaft 50, also rotates and thus causes the spring 42 to rotate via the edges of the outer notch 53 applying a rotational force upon either the first prong 43 or the second prong 44. Thus, the prongs extend upwardly at least past a substantial part of the region of the outer hub 52 including the notch 53 so that the side edges of the notch 53 can grab upon either the first prong 43 or the second prong 44.

Extending longitudinally from the inner portion 51 is the central portion 54. The central portion 54 is generally comprised of a larger diameter than the inner portion 51. The central portion 54 is also preferably comprised of a uniform diameter. The central portion 54 receives the spool 60 of the drive unit 20.

Extending longitudinally from the central portion 54 is the outer portion 55. The outer portion 55 is generally comprised of a smaller diameter than the central portion 54. The outer portion 55 is also preferably comprised of a uniform diameter. The outer portion 55 extends through the outer hole 75 of the cover 70 to connect to the hand crank 80. The outer portion 55 may include an outer bearing 58 positioned between the outer portion 55 and the cover 70 adjacent the outer hole 75 to support the shaft 50 and assist the shaft 50 in rotating smoothly. The outer portion 55 may also be comprised of varying diameters, such as a portion comprised of a lesser diameter to connect to the hand crank 80.

iv. Spool

A spool 60 used to secure the elongated members 22, 23 to the drive unit 20 and receive the wound elongated members 22, 23 is coaxially positioned for bi-directional rotational movement around the central portion 54 of the shaft 50. The spool 60 preferably rotates freely and independently of the shaft 50, wherein the spool 60 is not connected to the shaft 50 and is merely supported by the shaft 50 and rotates around the shaft 50. The spool 60 thus includes a cylindrical center opening 61 of a uniform diameter extending through the spool 60 for receiving the central portion 54 of the shaft 50.

The spool 60 also includes a first side plate 62 defining a first side of the spool 60 and a second side plate 64 defining a second side of the spool 60. The first side plate 62 and the second side plate 64 may be comprised of a solid structure, a spoked structure or various other configurations. A first side opening 63 preferably extends through the first side plate 62 for receiving the end of the first elongated member 22 so that the first elongated member 22 may be affixed therein. Likewise, a second side opening 65 preferably extends through the second side plate 64 for receiving the end of the second elongated member 23 so that the second elongated member 23 may be affixed therein.

A vertically oriented divider 66 preferably equally separates the first elongated member 22 from the second elongated member 23 by defining a first chamber 67 for receiving the first elongated member 22 and a separate second chamber 68 for receiving the second elongated member 23. It is appreciated that in alternate embodiments, a single elongated member may extend from the spool 60, thus have no divider 66, wherein an initial elongated member 110 may attach to a linkage assembly 111 in which a first elongated member 22 and a second elongated member 23 may extend from for supporting the first end 101 and the second end 102 of the platform 100.

A projection 69 further extends toward the mounting plate 30 from the first side plate 62 in a perpendicular manner with respect to the first side plate 62. The projection 69 extends directly over the brake spring 42 and is positioned within the area defined by the notch 53 and between the first prong 43 and the second prong 44. When the hand crank 80 is used to rotate the shaft 50, the rotation of the outer hub 52 attached to the shaft 50 causes the edges of the notch 53 or inside edge of the first prong 43 to push on the projection 69 and thus rotate the spool 60 to wind or unwind the elongated members 22, 23.

When no rotational force is applied to the hand crank 80, the projection 69 rotates against the inside edge of the first prong 43 in a manner that would lower the platform 100 and load 12, and thus rotatably pushes on the first prong 43 to tighten the brake spring 42 against the fixed brake bushing 40. As the brake spring 42 tightens, the frictional forces securing the brake spring 42 in place with respect to the brake bushing 40 overcome the rotational forces of the spool 60 and thus prevent the spool 60 from rotating backward.

v. Cover

A cover 70 is positioned over the rotating components to protect the user from coming into contact with the rotating components during use and to protect the rotating components from being engaged by foreign objects that could cause harm or damage. The cover 70 generally includes an inner rim 71 for being positioned over a radial outside of the lip 34 of the mounting plate 30 which may include a plurality of holes to align with the attachment holes 32 for securing the cover 70 thereto via fasteners.

Extending from the inner rim 71 is an enclosure portion 72 that extends over the shaft 50 and spool 60. The enclosure portion 72 includes an outer hole 75 for the outer portion 55 of the shaft 50 to extend through for attachment of the hand crank 80. The enclosure portion 72 also includes an upper opening 74 that is aligned with the first chamber 67 and the second chamber 68 of the spool 60 on an upper side for the first elongated member 22 and the second elongated member 23 to extend through.

vi. Hand Crank

The hand crank 80 is preferably directly connected to the outer portion 55 of the shaft 50 for rotating the shaft 50 and spool 60. The hand crank 80 generally includes a handle 81 for the user to grasp. The handle 81 may rotate independently of the hand crank 80. Extending from the handle 81 is a lever 83 and a connector 84 perpendicularly extends from the lever 83 for connecting the hand crank 80 to the outer portion 55 of the shaft 50. The connector 84 preferably attaches the hand crank 80 to the shaft 50 outside of the enclosure portion 72.

C. Horizontal Support

A horizontal support 90 extends along a horizontal surface 15 (preferably a ceiling of a garage, shed, etc.) for transitioning the elongated members 22, 23 from a first vertical direction, to a horizontal direction, to an opposite vertical direction. The horizontal support 90 is preferably comprised of an elongated support and may be separate or integral with the horizontal surface 15, such as a ceiling. The horizontal support 90 is positioned above the drive unit 20.

A first double pulley 91 extends vertically downward from the horizontal support 90 adjacent an end directly above or aligned with the upper opening 74 of the drive unit 20 to receive the first elongated member 22 and the second elongated member 23. The first double pulley 91 transitions the direction of the elongated members 22, 23 from a vertical direction along the vertical surface 14 to a horizontal direction along the horizontal surface 15.

A second double pulley 92 extends vertically downward from the horizontal support 90 directly above a first end 101 of the platform 100 closest to the drive unit 20 to receive the first elongated member 22 and the second elongated member 23. The second double pulley 92 transitions the direction of the first elongated member 22 from a horizontal direction along the vertical surface 14 to a vertical direction towards the first end 101 of the platform 100. The second elongated member 23 is simply guided by the second double pulley 92 in a horizontal direction towards the third pulley 93.

The third pulley 93 extends vertically downward from the horizontal support 90 directly above a second end 102 of the platform 100 furthest from the drive unit 20 to receive the second elongated member 23. The third pulley 93 transitions the direction of the second elongated member 23 from a horizontal direction along the vertical surface 14 to a vertical direction towards the second end 102 of the platform 100.

D. Platform

Various types of platforms 100 or load 12 carrying units may be secured to the first elongated member 22 and the second elongated member 23. In the preferred embodiment a flat platform 100 is utilized and oriented in a direction similar to the horizontal support 90. The platform 100 includes a plurality of corner posts 103 extending upward from each of the corners. The platform 100 may or may not include sides to ensure the load 12 remains secure thereupon.

A first linkage assembly 105 extends from the end of the first elongated member 22 to connect a pair of first connecting members 106. The first connecting members 106 subsequently connect to each corner of the first end 101 of the platform 100. It is appreciated that more or less or no connecting members may be used with alternate embodiments. The first linkage assembly 105 may allow for removal of the first connecting members 106 from the first elongated member 22 or rotational movement (via a swivel) of the first connecting members 106 about the first elongated member 22.

A second linkage assembly 108 extends from the end of the second elongated member 23 to connect a pair of second connecting members 109. The second connecting members 109 subsequently connect to each corner of the second end 102 of the platform 100. It is appreciated that more or less or no connecting members may be used with alternate embodiments. The second linkage assembly 108 may allow for removal of the second connecting members 109 from the second elongated member 23 or rotational movement (via a swivel) of the second connecting members 109 about the second elongated member 23. The first connecting member 106 and the second connecting member 109 may be comprised of cables, ropes, or any elongated structure capable of supporting the weight of the platform 100 and load 12. Alternately, the platform 100 may be omitted and the elongated members 22, 23 may directly attach to the load 12.

E. Operation of Preferred Embodiment

In use, the platform 100 is first connected to the first elongated member 22 and the second elongated member 23 via the first linkage assembly 105 and the second linkage assembly 108. The platform 100 must then be lowered to the floor or to a height in which a load 12 may be placed upon the platform 100, removed from the platform 100, or accessed.

To lower the platform 100, the hand crank 80 is rotated in a first rotational direction. As the handle 81 is rotated, the shaft 50 rotates which causes the spool 60 to rotate to unwind the elongated members 22, 23. The spool 60 rotates via the edges of the notch 53 of the outer hub 52 rotatably forcing the braking spring 42 to rotate around the brake bushing 40. The brake spring 42 is oriented upon the brake bushing 40 to loosen around the brake bushing 40 when a first rotational direction is applied to it so that the brake spring 42 is able to rotate around the brake bushing 40. The brake spring 42 loosens around the brake bushing 40 because the inside diameter of the brake spring 42 increases by pushing on the outside edge of the second prong 44. As the brake spring 42 rotates, the projection 69 extending within the notch 53 of the outer hub 52 is engaged by the edges of the notch 53 adjacent the second prong 44 and the spool 60 is rotated with the brake spring 42, outer hub 52 and shaft 50.

When the platform 100 is lowered to a desired height, the hand crank 80 may be released thus allowing the brake assembly to effectively prevent the spool 60 from unwinding further. The brake assembly works by the projection 69 rotating in the first rotational direction without the outer hub 52, thus causing the projection 69 to engage the inside edge of the first prong 43 and subsequently tighten the brake spring 42 around the brake bushing 40 by decreasing an inside diameter of the brake spring 42. This a frictional force of the tightened brake spring 42 against the brake bushing 40 overcomes the weight of the platform 100 and load 12 so that the spool 60 is prevented from unwinding further. It is thus appreciated that the spool 60 of the present invention automatically locks when no rotational force is being applied to the hand crank 80 so that the platform 100 will not lower unwantingly. It is appreciated that the spool 60 generally only freely rotates toward the first direction via gravity being applied to the platform 100; however the brake spring 42 will prevent the spool 60 from moving in either rotational direction because the spool 60 will be pushing on the inside of the first prong 43 or the second prong 44 which will cause the brake spring 42 diameter to decrease and thus tighten upon the brake bushing 40.

To raise the platform 100, the hand crank 80 is rotated in a second rotational direction opposite the first directional rotation. As the handle 81 is rotated, the shaft 50 rotates which causes the spool 60 to rotate and wind the elongated members 22, 23. The spool 60 rotates via the edges of the notch 53 of the outer hub 52 rotatably forcing the braking spring 42 to rotate around the brake bushing 40. The brake spring 42 is oriented upon the brake bushing 40 to loosen around the brake bushing 40 when a second rotational direction is applied to it so that the brake spring 42 is able to rotate around the brake bushing 40. The brake spring 42 loosens around the brake bushing 40 because the inside diameter of the brake spring 42 increases by pushing on the outside edge of the first prong 43. As the brake spring 42 rotates, the projection 69 extending within the notch 53 of the outer hub 52 is engaged by the inside edge of the first prong 43 and the spool 60 is rotated with the brake spring 42, outer hub 52 and shaft 50. The platform 100 may be raised to a desired height by simply rotating the hand crank 80.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A drive unit, comprising:

a mounting plate;

a shaft rotatably connected to said mounting plate;

a spool coaxially positioned along said shaft, wherein said spool rotates independently of said shaft;

at least one elongated member wound upon said spool;

a hand crank connected to said shaft for winding or unwinding said at least one elongated member upon said spool; and a brake assembly mounted to said drive unit, wherein said brake assembly includes a torsion spring;

wherein a first force applied with said hand crank in a first rotational direction upon said torsion spring lessens a tension of said torsion spring allowing said torsion spring and said spool to rotate;

wherein a second force applied with said spool in a second rotational direction upon said torsion spring increases a tension of said torsion spring preventing said torsion spring and said spool from rotating.

2. The manual storage lift system of claim 1, wherein a third force applied with said hand crank in said second rotational direction upon said torsion spring lessens a tension of said torsion spring allowing said torsion spring and said spool to rotate.

3. The manual storage lift system of claim 1, wherein said torsion spring is positioned around an inner hub of said mounting plate.

4. The manual storage lift system of claim 3, wherein said inner hub is stationary.

5. The manual storage lift system of claim 4, wherein said inner hub is concentric with said shaft.

6. The manual storage lift system of claim 5, wherein said shaft includes an outer hub, wherein said outer hub is positioned around said torsion spring.

7. The manual storage lift system of claim 6, wherein said outer hub rotates with said shaft.

8. The manual storage lift system of claim 7, wherein said outer hub includes a notch extending within said outer hub.

9. The manual storage lift system of claim 8, wherein said notch is parallel with said torsion spring.

10. The manual storage lift system of claim 9, wherein said torsion spring includes a first prong extending from a first end of said torsion spring and a second prong extending from a second end of said torsion spring, wherein said first prong and said second prong are positioned within said notch.

11. The manual storage lift system of claim 10, wherein said spool includes a projection extending from a side of said spool, wherein said projection is positioned within said notch between said first prong and said second prong.

12. The manual storage lift system of claim 1, wherein said shaft includes an outer hub, wherein said outer hub is positioned around said torsion spring.

13. The manual storage lift system of claim 12, wherein said outer hub includes a notch, wherein said spring extends within said notch.

14. The manual storage lift system of claim 12, wherein said spring includes a first prong and a second prong, wherein said first prong engages a first side of said notch in said first rotational direction and wherein said second prong engages a second side of said notch in said second rotational direction.

15. The manual storage lift system of claim 1, wherein said spool includes a divider defining a first chamber and a second chamber within said spool.

16. The manual storage lift system of claim 15, wherein said at least one elongated member includes a first elongated member wound within said first chamber of said spool and a second elongated member wound within said second chamber of said spool.

17. A storage lift system for raising and lowering a load connected thereto, comprising:

a drive unit including:

a mounting plate for securing said drive unit to a vertical surface, wherein said mounting plate includes a stationary inner hub;

a shaft rotatably connected to said mounting plate, wherein said shaft includes an outer hub rotatable with said shaft for being mounted around said inner hub;

wherein said outer hub includes a notch extending within said outer hub;

a spool coaxially positioned along said shaft, wherein said spool rotates independently of said shaft;

wherein said spool includes a divider defining a first chamber and a second chamber within said spool;

a first elongated member extending from said spool, wherein a first initial end of said first elongated member is connected to said spool for being wound around said first chamber of said spool;

a second elongated member extending from said spool, wherein a second initial end of said second elongated member is connected to said spool for being wound around said second chamber of said spool;

a hand crank connected to said shaft for rotating said spool;

a brake assembly mounted to said drive unit for braking said spool, wherein said brake assembly includes a brake bushing and a torsion spring;

wherein said brake bushing is non rotatably mounted to said inner hub and wherein said torsion spring is rotatably mounted to said brake bushing;

wherein said torsion spring is concentric with said shaft;

wherein said brake bushing and said torsion spring are mounted between said inner hub and said outer hub;

wherein said torsion spring includes a first prong extending from a first end of said torsion spring and a second prong extending from a second end of said torsion spring, wherein said first prong and said second prong are positioned within said notch;

wherein said spool includes a projection extending from a side of said spool, wherein said projection is positioned within said notch between said first prong and said second prong;

a cover extending from said mounting plate for at least partially surrounding said spool;

wherein a first force applied with said hand crank in a rotational direction upon said torsion spring lessens a tension of said torsion spring allowing said torsion spring and said spool to rotate;

wherein a second force applied with said spool in said rotational direction upon said torsion spring increases a tension of said torsion spring preventing said torsion spring and said spool from rotating;

wherein a third force applied with said hand crank in a said second rotational direction upon said torsion spring lessens a tension of said torsion spring allowing said torsion spring and said spool to rotate;

wherein said first prong engages a first side of said notch in said first rotational direction and wherein said second prong engages a second side of said notch in said second rotational direction;

a horizontal support mounted to a horizontal surface overhead of said drive unit;

a plurality of pulleys attached to said horizontal support;

wherein said first elongated member and said second elongated member are wound at least partially around said plurality of pulleys; and a platform for supporting a load;

wherein a first distal end of said first elongated member is mechanically connected to a first end of said platform and wherein a second distal end of said second elongated member is mechanically connected to a second end of said platform.

* * * * *